US007506587B1

(12) United States Patent
Anderson

(10) Patent No.: US 7,506,587 B1
(45) Date of Patent: Mar. 24, 2009

(54) MODULAR PROJECTILE SYSTEM

(75) Inventor: Steven E. Anderson, Fredericksburg, VA (US)

(73) Assignee: The United States of Americas as represented by the Secretary of the Navy, Washington, DC (US)

( * ) Notice: Subject to any disclaimer, the term of this patent is extended or adjusted under 35 U.S.C. 154(b) by 150 days.

(21) Appl. No.: 11/713,833

(22) Filed: Feb. 20, 2007

(51) Int. Cl.
*F42B 12/58* (2006.01)

(52) U.S. Cl. ..... 102/489; 102/473

(58) Field of Classification Search ..... 102/473, 102/498, 439, 445, 447, 489
See application file for complete search history.

(56) References Cited

U.S. PATENT DOCUMENTS

| | | | | |
|---|---|---|---|---|
| 4,364,530 A | | 12/1982 | Ripley-Lotee et al. | 244/3.22 |
| 4,781,117 A | | 11/1988 | Garnett et al. | 102/493 |
| 4,899,956 A | | 2/1990 | King et al. | 244/3.21 |
| 5,086,703 A | | 2/1992 | Klein | 102/439 |
| 5,115,707 A | | 5/1992 | Kutzli | 83/20.1 |
| 5,238,204 A | * | 8/1993 | Metz | 244/3.15 |
| 5,598,928 A | | 2/1997 | Hossard et al. | 206/509 |
| 6,079,334 A | * | 6/2000 | Roheim | 102/394 |
| 2004/0069176 A1 | | 4/2004 | Kellner | 102/476 |
| 2004/0200375 A1 | | 10/2004 | Kautzsch et al. | 102/385 |
| 2006/0266249 A1 | * | 11/2006 | Illesi | 102/498 |
| 2006/0272538 A1 | * | 12/2006 | Janik et al. | 102/473 |
| 2007/0006861 A1 | * | 1/2007 | Sapir | 124/17 |

FOREIGN PATENT DOCUMENTS

| | | | |
|---|---|---|---|
| DE | 19917189 A1 | * | 10/2000 |
| DE | 19944379 A1 | * | 3/2001 |
| EP | 1 399 706 | | 4/2004 |
| FR | 2654822 A1 | * | 5/1991 |
| WO | WO 03/001141 | | 1/2003 |

* cited by examiner

*Primary Examiner*—James S Bergin
(74) *Attorney, Agent, or Firm*—Gerhard W. Thielman, Esq.

(57) ABSTRACT

A modular gun-launch projectile is provided to include a core section; a base section, a payload section and a nose section. The base section can be translatably inserted into the core section. The payload section includes an annular opening that enables the core section to pass therethrough. The nose section can be inserted into the core section. The sections are separable into discrete components and can be assembled together into an all-up-round. The core section can be a cylindrical solid rod or cylindrical hollow tube. The base section can include a propulsion system. The payload section can be a unitary explosive or contain submunitions. The nose section can include a fuse, a seeker, an air inlet, a guidance receiver and/or guidance vanes.

2 Claims, 1 Drawing Sheet

100
110
120
130
140

111
112
113
114
115
116
117
118
119
110

121
122
123
124
125
126
127
128
120

131
132
133
134
130

141
142
143
144
145
146
140

MODULAR PROJECTILE SYSTEM

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to the gun-fired projectiles, and more particularly to modular shell munitions fired from an artillery gun.

Military organizations operate with various ordnance-delivery techniques. A ground-based artillery gun may fire projectiles at a target to deliver a hostile payload. These projectiles may be designed and manufactured for a particular function, such as high explosive, incendiary, fragmentation, shape-charge, etc. Such artillery may include standardized medium-to-large-bore calibers, such as 5"/54, 5"/62, 155 mm (millimeter), 120 mm and 105 mm.

SUMMARY

Conventional projectiles yield disadvantages addressed by various exemplary embodiments of the present invention. In particular, lack of modularity prevents upgrade of munitions from obsolescence and limits options for safe storage and handling of inventory.

Various exemplary embodiments provide a modular gun-launch projectile is provided to include a core section; a base section, a payload section and a nose section. The base section can be translatably inserted into the core section. The payload section includes an annular opening that enables the core section to pass therethrough. The nose section can be inserted into the core section. The sections are separable into discrete components and can be assembled together into an all-up-round.

In various exemplary embodiments, the core section can be a cylindrical solid rod or cylindrical hollow tube. In alternate embodiments, the base section can include a propulsion system. Other embodiments provide for the payload section being a unitary explosive or contain submunitions, and for the nose section including a fuse, a seeker, an air inlet, a guidance receiver and/or guidance vanes.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figures 1, 2A, 2B, 2C, 2D:
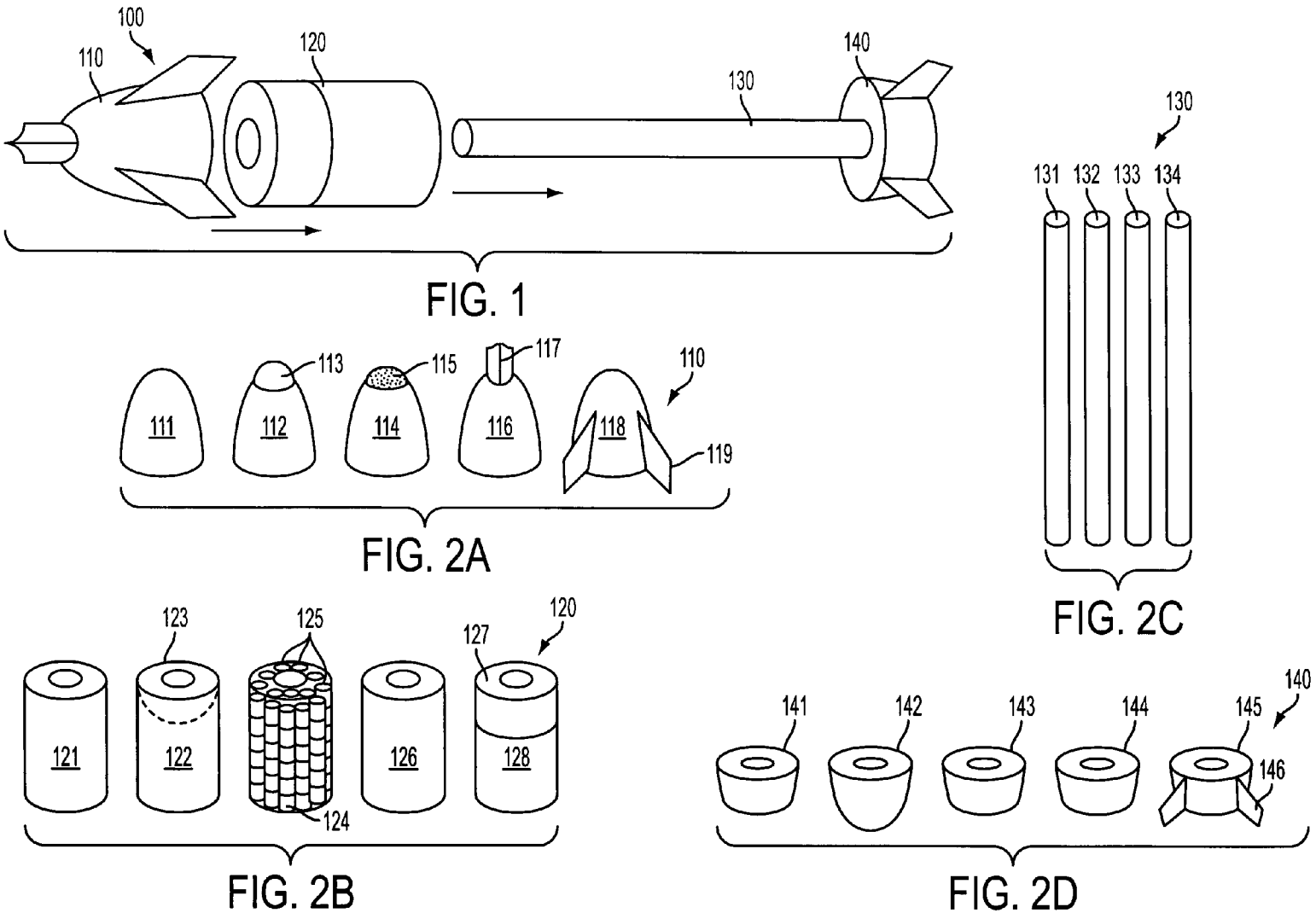
FIG. 1 is an isometric exploded view of a munitions shell.
FIG. 2A is an isometric view of exemplary nose sections.
FIG. 2B is an isometric view of exemplary payload sections.
FIG. 2C is an isometric view of exemplary core sections.
FIG. 2D is an isometric view of exemplary base sections.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Uniformed members of armed forces may use artillery to fire projectiles at a hostile target. Medium-to-large-scale ammunition can be expensive due to tight tolerances and limited commercial potential for amortizing development costs. Further, portions of a munitions shell may possess a limited shelf-life due to chemical degradation of constituent materials or suffer from technological obsolescence before deployment.

In order to provide greater flexibility to the warfighter, a modular design for a munitions shell is described herein. By subdividing functional and physically separable components of a projectile, ammunition can be configured in the field for a specific intended purpose. In addition, separate storage of the components enables reduction in encumbered space in magazines. Additionally, storage safety can be enhanced by isolating chemically energetic elements, FIG. 1 shows an exemplary modular projectile 100 in exploded view. A fore or nose assembly 110 represents the forward portion of the projectile 100. A hollow mid-section assembly 120 represents an interior payload portion of the projectile 100. A core section 130 represents a support connector for the projectile 100. Finally, a base assembly 140 represents the aft portion of the projectile 100. The assembled all-up-round can be contained in a separate outer casing. Alternatively, each component can include its respective portion of an outer casing to form an enclosed shell upon assembly.

For assembly, the nose and payload portions 110, 120 may be translated aft along the core section 130 along the direction shown by the arrows, which mates with the base assembly 140 to produce an all-up-round of a standard size, mass and center-of-gravity. Alternatively, the payload portion 120 may be rotated concurrently with the translation aft along the core section 130. Also alternatively, the core section 130 may be mated with the nose 110, with the payload and base sections 120, 140 being translated forward along the core section 130.

FIG. 2A illustrates exemplary functional candidates for the nose assembly 110. Example nose components include an inert unitary nose 111, a nose 112 having a simple fuse tip 113, a nose 114 having a seeker tip 115, a hollow nose 116 with an air inlet 117, and a nose 118 having guidance vanes 119. The noses 11, 112, 114, 116, 118 may be give in shape as shown, or alternatively may form a hemisphere, cone or frustum in shape. The nose assembly 110 may include a cavity at its aft end to engage the core section 130 for assembly of the projectile 100.

The fuse 113 may be triggered by ambient pressure or alternate means for determining altitude, physical contact or proximity sensing. The seeker 115 may be singular (e.g., infrared or radar) or multimode. The vanes 119 may be steerable in response to guidance commands. The nose assembly 110 may incorporate instruments for receiving global positioning system (GPS) information to facilitate guidance for accurate delivery on target.

FIG. 2B shows exemplary functional candidates for the annular payload assembly 120. The payload assembly 120 includes an annulus that forms an opening or cavity extending along its longitudinal length at its axis of rotational symmetry. The core portion 130 may pass through the annulus during assembly of the projectile 100. The representative examples include a unitary annular cylinder 121, a unitary annular cylinder 122 having a shape charge fore portion 123, a submunition payload 124 with cylindrical portions 125 disposed symmetrically about the axis through which the core portion 130 may pass, a flechette dispenser 126, and a hybrid payload from an explosive 127 and a rocket motor 128.

The unitary cylinder 122 may be composed of a variety of fill materials having characteristics appropriate to the mission. These materials may be, for example, inert, high explosive, blast fragmentation, etc. The rocket motor 128 may represent a solid propellant section or alternatively a solid fuel portion used in conjunction with a separate oxidizer source. The payload assembly 120 includes a cavity extending therethrough along its longitudinal axis through which the core section 130 may be inserted for assembly of the projectile 100.

FIG. 2C provides exemplary candidates for the core section 130, which may include an embedded data transfer backplane, such as wires, fiber optic or other conductive connectors to enable communication between a GPS receiver in the nose and a guidance control system that may be located in the base section 140. The core section may preferably form substantially an elongated cylinder to minimize surface area that faces the payload 120. Alternatively, the core section 130 may include a notch or protrusion along its length to facilitate alignment of the payload 120 and/or other components for the projectile 100.

The core section 130 may include representative examples, such as a hard and/or inert rod 131, a reactive rod 132, a hollow air feed tube 133 having structural integrity, and an oxidizer storage tube 134 having structural integrity. The rods 131, 132 may preferably be composed of high density metal or ceramic. The air tube 133 may preferably be used on conjunction with the hollow nose 116 with inlet 117. The oxidizer tube 134 may preferably be used on conjunction with a solid fuel motor payload portion 128.

FIG. 2D illustrates exemplary candidates for the base assembly 140, which may include representative examples, such as an inert frustum 141 that tapers aft, a boat-tail 142, a propulsion system 143, a steerable rocket motor assembly 144 and a steerable guidance assembly 145 with exterior fins 146. The base assembly 140 may include a cavity into which the core section 130 may be inserted. Those of ordinary skill in the art will recognize that the core section 130 may be longer than the combination of the payload 120 and the insertion cavities of the base 140 and the nose 110, thereby providing a gap between either the payload 120 and the base 140 and/or the nose 110 and the payload 120.

The propulsion system 143 may represent an air-breathing engine or a rocket motor assembly. The propulsion assemblies 143, 144 may each include a nozzle through which gaseous combustion exhaust products may be ejected supersonically. The steerable assembly 144 may include steerable nozzle flow vanes through which the exhaust may be thrust-vectored. The propulsion assemblies 143, 144 may be used in conjunction with a solid rocket motor 128 and/or an air-breathing propulsion engine that receives air through the inlet 119. The guidance assembly 145 may include a GPS receiver, instead of being incorporated in the nose assembly 110. The fins 146 may be steerable or fixed, depending on whether the nose assembly 118 includes steerable fins 119.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A modular gun-launch projectile comprising:

a core section that constitutes an annular tube;

a base section translatably insertable into the core section that includes a propulsion system;

a payload section having an opening that enables the core section to pass therethrough, the payload section including a plurality of submunitions arranged symmetrically around the opening; and a nose section insertable into the core section, the nose section including an air inlet communicatable with the tube, wherein the sections are separable into discrete components and can be assembled together.

2. The projectile according to claim 1, wherein the payload section is an annular cylinder having an annulus corresponding to the opening for passing the core section therethrough.

* * * * *